US005627732A

United States Patent [19]

Loh et al.

[11] Patent Number: 5,627,732

[45] Date of Patent: May 6, 1997

[54] MULTIPLE OUTPUT CURRENT MIRROR

[75] Inventors: Gee H. Loh; Mario Santi, both of Singapore, Singapore

[73] Assignee: SGS-Thomson Microelectronics S.A., Saint Geinis Pouilly, France

[21] Appl. No.: 448,803

[22] Filed: May 24, 1995

[30] Foreign Application Priority Data

May 27, 1994 [EP] European Pat. Off. ..... 94410039

[51] Int. Cl.[6] ..... G05F 3/02

[52] U.S. Cl. ..... 363/16

[58] Field of Search ..... 323/315, 312, 323/313, 314, 316; 330/257, 288

[56] References Cited

U.S. PATENT DOCUMENTS

| | | | |
|---|---|---|---|
| 3,982,172 | 9/1976 | Van de Plassche | 323/1 |
| 4,503,381 | 3/1985 | Bowers | 323/315 |
| 4,859,929 | 8/1989 | Raguet | 323/316 |
| 5,089,769 | 2/1992 | Petty et al. | 323/316 |
| 5,157,322 | 10/1992 | Llewellyn | 323/315 |
| 5,304,862 | 4/1994 | Memida | 307/296.6 |

FOREIGN PATENT DOCUMENTS

| | | | |
|---|---|---|---|
| 0443239 | 8/1991 | European Pat. Off. | G05F 3/26 |
| 0596653 | 5/1994 | European Pat. Off. | G05F 3/26 |
| 2255760 | 7/1975 | France | H04L 11/14 |

OTHER PUBLICATIONS

Austrian Search Report dated Nov. 16, 1995.

European Search Report for European Patent Application No. 94 41 0039 filed May 27, 1994.

Improved Current Mirror For Low Beta Transistors, vol. 6B, NR. 32, p. 14, "Improved Current Mirror for Low Beta Transistors".

*Primary Examiner*—Aditya Krishnan

*Attorney, Agent, or Firm*—David M. Driscoll; James H. Morris

[57] ABSTRACT

A multiple output current mirror comprising at least three mirror-connected PNP transistors whose bases are connected to a first node, at least three cascode-connected transistors, each cascode transistor being associated to one mirror transistor, a current input corresponding to the collector of the first cascode transistor, and mirror outputs corresponding to the collectors of the two other cascode transistors. The current mirror further comprising means for detecting the base current of each mirror transistor and for reproducing this base current on the collector of the cascode transistor to which each mirror transistor is associated.

38 Claims, 5 Drawing Sheets

| | Fig 1 | Fig 2 | Fig 3 | Fig 4 | Fig 5 | Fig 6 |
|---|---|---|---|---|---|---|
| Io1/Iin | 1-3/β | 1-6/β | 1 | 1-1.5/β | 1 | 1 |
| Io2/Iin | 1-3/β | 1-6/β | 1-3/β | 1-1.5/β | 1 | 1 |
| Io2/Io1 | 1 | 1 | 1-3/β | 1 | 1 | 1 |
| high output impedance ? | No | Yes | Yes | Yes | Yes | Yes |
| N° of transistors | 3 | 6 | 6 | 7 | 12 | 10 |
| Io/Iin depends upon N° of transistors ? | Yes | Yes | Yes | Yes | No | No |
| Sensitive to Iin ? | | | | | Yes | No |

MULTIPLE OUTPUT CURRENT MIRROR

BACKGROUND OF THE INVENTION

1. Field of the Invention

The present invention relates to a multiple output current mirror. Such current mirrors are commonly used in monolithic integrated circuits, for example as an active load, a current source, or a current polarity inverter.

2. Discussion of the Related Art

A current mirror reproduces an input current on at least one output. In this purpose, a current mirror uses bipolar transistors, for example PNP, having a common emitter and whose bases are connected to each other and to the collector of the transistor providing the input current. One basically considers that the emitter-base voltages Vbe of identical transistors formed on the same chip are identical. Two transistors having the same emitter surface will have substantially identical saturation currents. Thus, since the transistors are connected with a common emitter and have interconnected bases, the collector currents will also be identical.

A current mirror can be characterized by various operating parameters:

- the mirror ratio which corresponds to the ratio between the reproduced current on one output and the input current;
- the output impedance;
- the frequency stability;
- the sensitivity to the gain variations of the constituting transistors; and
- the current operating range for a constant mirror ratio.

For a multiple output current mirror, two additional parameters are to be taken into account, that is:

- the output matching ratio which corresponds to the ratio between the currents reproduced on two outputs of the mirror; and
- the effect of the number of outputs on the mirror ratio.

FIG. 1 shows a basic current mirror having two out-puts and comprising three PNP transistors T1, T2, T3 having a common emitter. The emitters of the three transistors are connected to a supply voltage Vcc. The bases of the transistors are connected to a node A connected to the collector of transistor T1. The input current Iin to be reproduced on the mirror outputs originates from node A, that is from the collector of transistor T1, and the outputs correspond to the collector currents of transistors T1 and T2.

For a given input current Iin, the collector current of transistor T1 is equal to current Iin less the three base currents of transistors T1, T2 and T3. Assuming that the three transistors have the same emitter surface, this means that their respective base currents Ib are identical. So, the collector current Ic1 of transistor T1 is Ic1=Iin−3Ib. The emitter current Ie1 of transistor T1 is Ie1=Iin−2Ib. As transistors T1, T2, T3 have the same base-emitter voltage Vbe, they have the same emiter current. Therefore, the emitter currents Ie2 and Ie3 of transistors T2, T3 are also equal to Iin−2Ib. The collector currents Io1 and Io2 of transistors T2 and T3 are accordingly equal to Iin−3Ib.

The mirror ratio of such a current mirror is accordingly identical for each output. This mirror ratio is equal to $1-3/\beta$, where $\beta$ is the current gain of the transistors, that is Ic/Ib. As this ratio is generally considered in first approximation as equal to 1, it can be considered that the real mirror ratio presents an "error" that is equal to $3/\beta$. In an example where $\beta=50$, as usual for PNP transistors, this "error" is equal to 6% and the mirror ratio is equal to 0.94.

Such a circuit presents a low output impedance which causes current variations on the outputs when the output voltage varies due to the Early effect. Additionally, as the mirror ratio takes into account the number of base currents Ib on the node A, when the transistor number increases, this ratio decreases. Furthermore, as the gain of a transistor varies with the operating temperature, such a circuit can operate only on a small current range.

FIG. 2 shows a current mirror using a cascode configuration for limiting the Early effect and providing a very high output impedance. This circuit also improves the mirror ratio. Each mirror transistor T1, T2 and T3 is associated with a cascode PNP transistor. A first cascode transistor T4 has its emitter connected to the node A while its collector constitutes a second node B. Node B receives the base currents Ib of transistor T4 and of two other PNP transistors T5 and T6. The emitter of transistor T6 is connected to the collector of transistor T3. The output currents Io1 and Io2 of the circuit correspond to the collector currents of the cascode transistors T5 and T6 while the input current Iin originates from the collector of the first cascode transistor T4. The operation of this circuit is similar to the one of FIG. 1.

For a given input current Iin, the collector current Ic4 of transistor T4 is equal to Iin less the three base currents of transistors T4, T5, T6. Supposing that the cascode transistors T4, T5, T6 have the same emitter surface area, those base currents are identical. So, Ic4=Iin−3Ib. The emitter current Ie4 of transistor T4 is Ie4=Iin−2Ib. The current Ie4 is also equal to the sum of the collector current Ic1 of transistor T1 and of the three base currents of transistors T1, T2, T3.

Assuming that the emitter surface areas of the mirror transistors T1, T2, T3 are equal to the emitter surface areas of the cascode transistors T4, T5, T6, each base current is equal to Ib. So, Ie1=Ie4−3Ib=Iin−5Ib. The emitter current Ie1 of transistor T1 is Ie1=Iin−4Ib. As transistors T1, T2, T3 have the same emitter-base voltage Vbe, they have the same emitter current. Therefore, the emitter currents Ie2 and Ie3 of transistors T2 and T3 are Ie2=Ie3=Ie1=Iin−4Ib. Their collector current Ic corresponds to the emitter current Ie less one base current Ib and is equal to Iin−5Ib. Those collector currents Ic2 and Ic3 are respectively identical to the emitter currents Ie5 and Ie6 of transistors T5 and T6. The output currents Io1 and Io2 that correspond to the collector currents of transistors T5 and T6 are therefore: Io1=Io2−Iin−6Ib.

The limitation of the Early effect is due to the fact that the collector-emitter voltages of the mirror transistors T1, T2, T3 are fixed at an identical value equal to Vbe. Therefore, the use of cascode transistors makes the outputs Io1 and Io2 less sensitive to variations of the supply voltage Vcc and of the loads, the outputs having an high impedance. However, as indicated above, in this circuit, the mirror ratio is $1-6/\beta$, that is the "error" is twice higher than in the example of FIG. 1. The drawbacks indicated in connection with FIG. 1 in this respect are therefore increasing.

FIG. 3 shows a Wilson-type current mirror. This circuit corresponds to the one of FIG. 2, but the connecting node A of the bases of transistors T1, T2 and T3 corresponds now to the collector of transistor T2 and not of transistor T1. Therefore, the effect of the base current Ib is compensated on the first output Io1 but the mirror ratio remains poor for the other outputs.

For a given input current Iin, the collector current Ic4 of transistor T4 is equal, as before, to this current Iin less the three base currents of transistors T4, T5, T6. Those base currents being identical, Ic4=Iin−3Ib, Ie4=Ic4+Ib=Iin−2Ib, and Ie1=Iin−Ib. As the transistors T1, T2 and T3 have the same base-emitter voltage Vbe, they have identical emitter currents equal to Iin–Ib. Their collector current Ic corresponds to their emitter current Ie less their base current Ib and is equal to Iin–2Ib. The emitter current Ie5 of transistor T5 is equal to this collector current plus the three base currents of transistors T1, T2 and T3, that is: Iin+Ib. Therefore, the collector current of transistor T5 which corresponds to the first output current Io1 is equal to Iin. However, the collector current of transistor T6 that corresponds to the current of the second output Io2 is equal to Iin–3Ib.

Accordingly, this circuit provides a good mirror ratio on the first output but a poor mirror ratio on the second one. The matching ratio is equal to $1-3/\beta$, which is unsatisfactory.

FIG. 4 shows another circuit for reducing the effect of the gain $\beta$ of the transistors on the mirror ratio while keeping a matching ratio equal to 1. This circuit is similar to the one of FIG. 3 but the connection node A of the bases of transistors T1, T2 and T3 now corresponds to the emitter of a multi-collector transistor T7. Transistor T7 aims at compensating the collector currents of mirror transistors T1, T2 and T3. The base of transistor T7 is connected to the connection node B of the bases of the cascode transistors T4, T5 and T6. The two collectors of transistor T7 are respectively connected to the collector of transistor T5 and the collector of transistor T6.

As before, for a given input current Iin, one obtains Ie1=Ie2=Ie3=In–Ib. The collector currents Ic5 and Ic6 of the cascode transistors T5 and T6 are Ic5=Ic6=Iin–3Ib (The effect of the base current Ib7 of transistor T7 on the value of the collector current Ic1 of transistor T1 is neglected; this is due to the fact that this base current is of the second order with respect to Ib, transistor T7 being fed by the three base currents of the mirror transistors T1, T2 and T3). The collectors of transistor T7 have the same surface. Therefore, the emitter current Ie7 is divided between the collectors. As Ie7=3Ib and as the base current of transistor T7 is neglected, the current on each collector is 1.5Ib. Therefore, the value of the output currents Io1 and Io2 is Io1=Io2=Iin–1.5Ib.

So, the circuit of FIG. 4 improves the mirror ratio with respect to the former circuits while the matching ratio remains equal to 1. Another circuit for obtaining a multiple output mirror current wherein the mirror ratio is substantially equal to 1 for all the outputs is shown in FIG. 5.

It comprises three mirror transistors T1, T2 and T3 and three cascode transistors T4, T5 and T6. It also comprises two transistor pairs T7, T8 and T9, T10 respectively associated with current generators 1 and 2. The transistors T7 and T9 are NPN transistors and their collectors are connected to the supply voltage Vcc. Their emitters are connected to a first terminal of a current source, respectively 1 and 2, whose other terminal is grounded. The emitters are also connected to the respective base of the PNP transistors T8 and T10. The collectors of transistors T8 and T10 are grounded. Their respective emitters are connected to the respective base nodes B and A of the cascode transistors T4, T5, T6 and of the mirror transistors T1, T2, T3. The base of transistor T7 is connected to the collector of transistor T4 and the base of transistor T9 is connected to the collector of transistor T2.

With an input Iin, the collector current Ic4 of transistor T4 is equal to Iin, neglecting the base current Ib7 of transistor T7. So, Ie1=Iin+Ib and Ie1=Ie2=Ie3=Iin+2Ib. Therefore, the collector currents of transistors T5 and T6, that is the output currents Io1 and Io2, are equal to Iin.

This result is obtained while neglecting the effect of the base currents Ib7 and Ib9 on the collector currents Ic4 and Ic2 of transistors T4 and T2. Accordingly, such a circuit has suitable characteristics when the current Iin is high. However, it has a poor accuracy on a large range of input currents. This is due to the fact that, when the input current is low, the base currents Ib7 and Ib9 can no longer be neglected. In this case, those base currents are not, like for transistor T7 of FIG. 4, second order base currents, but are currents provided by current sources. Such a drawback is particularly significative when Iin is subject to high variations; for an AC current, a deformation of the output currents is caused.

An object of the invention is to provide a multiple output current mirror that has a good mirror ratio, equal to unity and that is stable when the input current varies.

Another object of the invention is to provide such a mirror ratio that is identical for a multiple output current mirror, even if the number of outputs is increased.

SUMMARY OF THE INVENTION

To reach these objects and others, one illustrative embodiment of the invention provides for a multiple output mirror current comprising at least three mirror-connected PNP transistors whose bases are connected to a first node, at least three cascode-connected transistors, each cascode transistor being associated to one mirror transistor, a current input corresponding to the collector of the first cascode transistor, mirror outputs corresponding to the collectors of the two other cascode transistors, further comprising means for ensuring that an output current at each one of the mirror output terminals is substantially equal to the input current, independent of the input current, multiplied by a mirror ratio of the one of the mirror output terminals.

According to another embodiment of the invention, the base current detecting means comprises a multi-collector transistor, the emitter of this multi-collector transistor being connected to the first node and its base being connected to the base and the collector of the first cascode transistor, the ratio between the surface areas of the collectors of the multi-collector transistor corresponding to the ratio between the surface areas of the emitters of the mirror transistors.

According to a further embodiment of the invention, the ratios between the surface areas of the emitters of the mirror transistors are identical to the ratios between the surface areas of the emitters of the cascode transistors with which they are associated.

According to another embodiment of the invention, the base current reproducing means comprises a current generator, one input of which receives a current equivalent to the base current of the first mirror transistor and one output of which draws a current from a second node corresponding to the interconnection of the bases of the cascode transistors providing the output currents, the current gain of the current generator being higher than the ratio between the sum of the surface areas of the output mirror transistors and the surface area of the emitter of the input mirror transistor.

According to a further embodiment of the invention, the current generator comprises two NPN transistors, the bases of which are connected to the collector of a first transistor and the emitters of which are grounded, the collector of the first transistor being connected to a first collector of the multi-collector transistor providing the value of the base current of the first mirror transistor, and the collector of the second transistor being connected to the second node of connection of the bases of the cascode transistors providing the output currents.

According to another embodiment of the invention, the multiple output current mirror further comprises means for setting the collector-emitter voltages of the mirror transistors at a same value. Preferentially, said means comprise an NPN transistor whose collector is connected to a voltage supply, whose base is connected to the first node of the bases of the mirror transistors, and whose emitter is connected to the second node of the bases of the output cascode transistors.

BRIEF DESCRIPTION OF THE DRAWINGS

Those objects, features and advantages and others of the invention will be explained in more detail in the following description of illustrative embodiments made in connection with the attached drawings wherein.

DETAILED DESCRIPTION

Figures 6, 7:
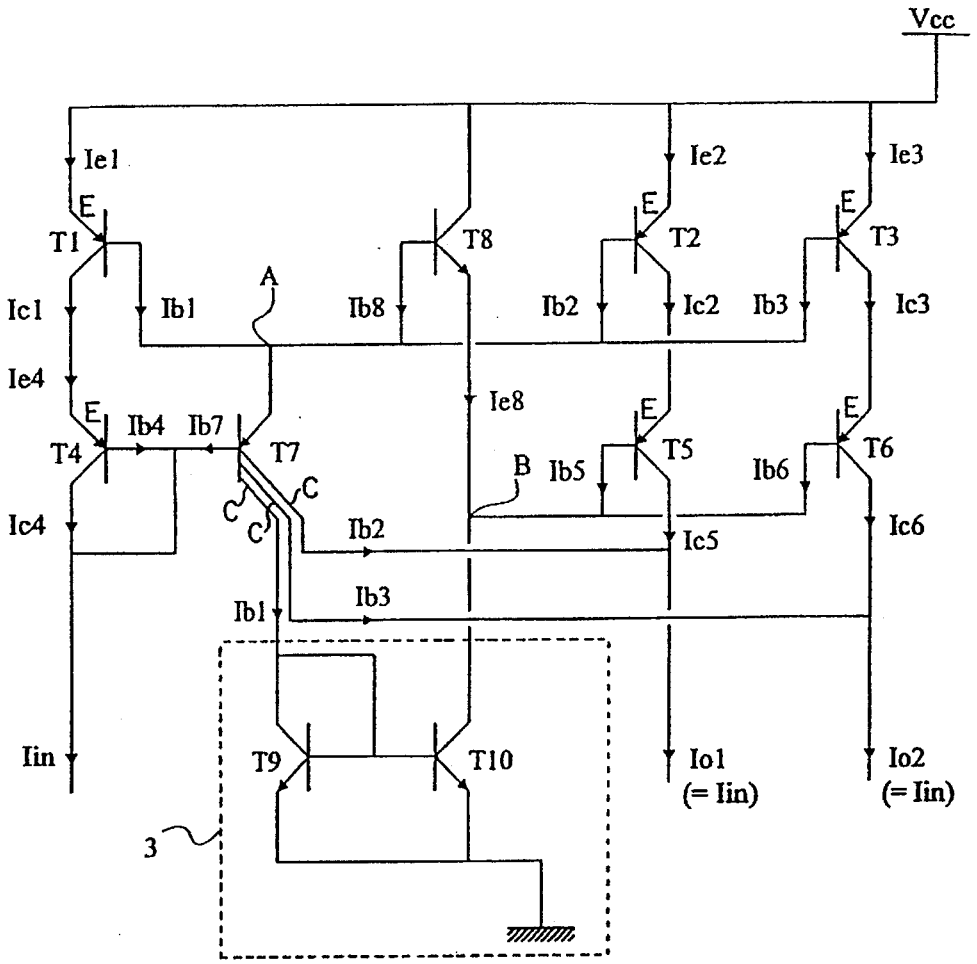
FIG. 6 shows an embodiment of a multiple output current mirror according to the invention.
FIG. 7 is a comparative table of the performance of various current mirrors.

The current mirror shown in FIG. 6 comprises mirror-connected PNP transistors T1, T2, T3 and cascode-connected PNP transistors T4, T5, T6. The emitters of transistors T1, T2, T3 are connected to the supply voltage Vcc and the respective collectors of transistors T1, T2, T3 are connected to the respective emitters of transistors T4, T5, T6. The bases of transistors T1, T2, T3 are connected to a first node A. The base of the first cascode transistor T4 is connected to its collector. The input Iin of the mirror corresponds to the collector of transistor T4. The bases of transistors T5, T6 are connected to a node B. Transistors T1–T6 have the same emitter surface area shown as E in FIG. 6;

A multi-collector PNP transistor T7 has an emitter connected to node A. The base of transistor T7 is connected to the base of the first cascode transistor T4. The multi-collector transistor T7 has a number of collectors equal to the number of mirror outputs plus 1. Two collectors of transistor T7 are respectively connected to a collector of a cascode transistor, respectively T5 and T6, forming the outputs Io1 and Io2 of the mirror. The first collector of transistor T7 is connected to an input terminal of a biasing current generator 3. The output terminal of generator 3 is connected to node B. Node B is also connected to the emitter of a NPN transistor T8. The collector of transistor T8 is connected to the supply voltage Vcc while its base is connected to node A.

The biasing current generator 3 comprises two mirror-connected NPN transistors T9 and T10. The collector of transistor T9 is connected to the input terminal of the generator, that is to the first collector of transistor T7. The collector of transistor T10 is connected to the output terminal of the generator, that is to node B. The emitters of transistors T9 and T10 are grounded while their respective bases are connected to the collector of transistor T9.

With an input current Iin, the collector current Ic4 of transistor T4 is equal to Iin–Ib, where Ib is the base current Ib4 of transistor T4. In this example, the base currents Ib1, Ib2, Ib3, Ib4, Ib5, Ib6 of the mirror and cascode transistors are equal and have the same value Ib. The emitter current Ie4 of transistor T4 is equal to the sum, Iin, of its collector current and its base current. So Ie1=Ie4=Iin and Ie1=Iin+Ib.

Due to the interconnection of the bases of the mirror transistors T1, T2, T3, the emitter currents Ie2, Ie3 of transistors T2 and T3 are also equal to Iin+Ib. The collector current Ic2, Ic3 is accordingly equal to Iin. The collector current of transistors T5, T6 is equal to Iin–Ib. The output currents Io1 and Io2 are therefore equal to the sum of the collector currents Ic5, Ic6 and of the currents Ib2, Ib3 of the collectors of transistor T7, respectively. The emitter current Ie7 of transistor T7 originating from node A is equal to the sum of three base currents (3Ib). Therefore, the current of each collector of transistor T7 is equal to Ib if those three collectors have the same surface area shown as C in FIG. 6; and Io1=Io2=Iin.

The base currents of transistors T7 and T8 can be neglected with respect to Ib1, Ib2 and Ib3 because they are always of the second order (they are two orders of magnitude lower) with respect to Ib1, Ib2 and Ib3.

One advantage of the invention (Io1=Io2=Iin whatever be Iin) is obtained by the association of the current generator 3 and the multi-collector transistor T7. The current generator 3 provides a biasing current for the transistor T7 by amplifying its input current originating from transistor T4. As this current is proportional to the base currents of the mirror transistors T1, T2, T3, it depends upon the input current value Iin.

Indeed, as the value of each collector current of transistor T7 is equal to Ib and as it comprises three collectors, its base current Ib7 is Ib7=3Ib/β. β being the current gain of the transistors. Ib being equal to Iin/β, the value of the base current Ib7 of transistor T7 is therefore equal to 3 Iin/$\beta^2$.

The output current of the current generator 3 is equal to the current of the first collector of transistor T7 multiplied by the current gain of the generator. In the example illustrated, this gain is fixed by the emitter surface area ratio of transistors T9 and T10 and is for example selected equal to 5. Accordingly, the emitter current Ie8 of transistor T8 is Ie8=5Ib–2Ib=3Ib. The base current Ib8=3Ib/β=3Iin/$\beta^2$.

It results from the above that the base currents Ib7 and Ib8 can always be neglected with respect to Ib, even for low values of the input current Iin. Therefore, the current mirror according to the invention operates satisfactorily while the input current varies in a large range. It will be noted that transistor T8 should not be saturated. In this purpose, the current generator 3 has a current gain providing a current higher than 2Ib. In other words, its gain is higher than 2, this number corresponding to the number of outputs of the mirror.

Each mirror transistor T1, T2, T3 has the same collector-emitter voltage Vce=Vbe. This can be deduced from the following. The potential of node A is equal to Vcc–Vbe, the base potential of transistor T4 is Vcc–2Vbe. The collector potential of transistor T1 is Vcc–Vbe. Therefore, Vce1=Vbe. Through transistor T8, the voltage of node β is also equal to Vcc–2Vbe. Therefore, the collector voltage of transistors T2, T3 equals Vcc–Vbe and Vce2=Vce3=Vbe. Accordingly, the presence of transistor T8 fixes all the collector-emitter voltages of the mirror transistors T1, T2, T3 to the same value Vbe.

Therefore, transistor T8 permits the compensation of one base-emitter voltage Vbe due to the presence of transistor T7. This transistor produces the same biasing voltage on the bases of the cascode transistors T5, T6, this voltage being equal to Vcc–2Vbe.

The multi-collector transistor T7 has the function of detecting the base currents of the mirror transistors T1, T2, T3 and provides compensation, at the collectors of output transistors T5, T6, of the base currents consumed in the circuit.

The above principle applies to a current mirror having more than two outputs. In this case, the circuit comprises additional branches similar to the branches T2, T5 and T3, T6 and the number of collectors of transistor T7 is increased as well as the current gain of the current generator 3.

Accordingly, the invention provides a multiple output current mirror which, whatever be the number of outputs, has a mirror ratio and a matching ratio equal to 1. The outputs of this mirror have a very high impedance and those features are maintained whatever be the value of the input current.

Figure 1:
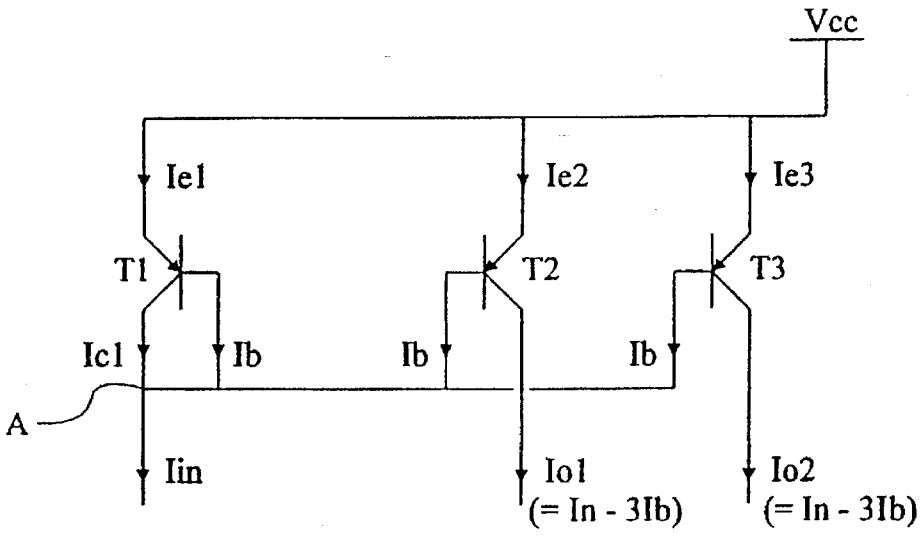
FIGS. 1–5 illustrate the state of the art and the problem to be solved.
Figure 2:
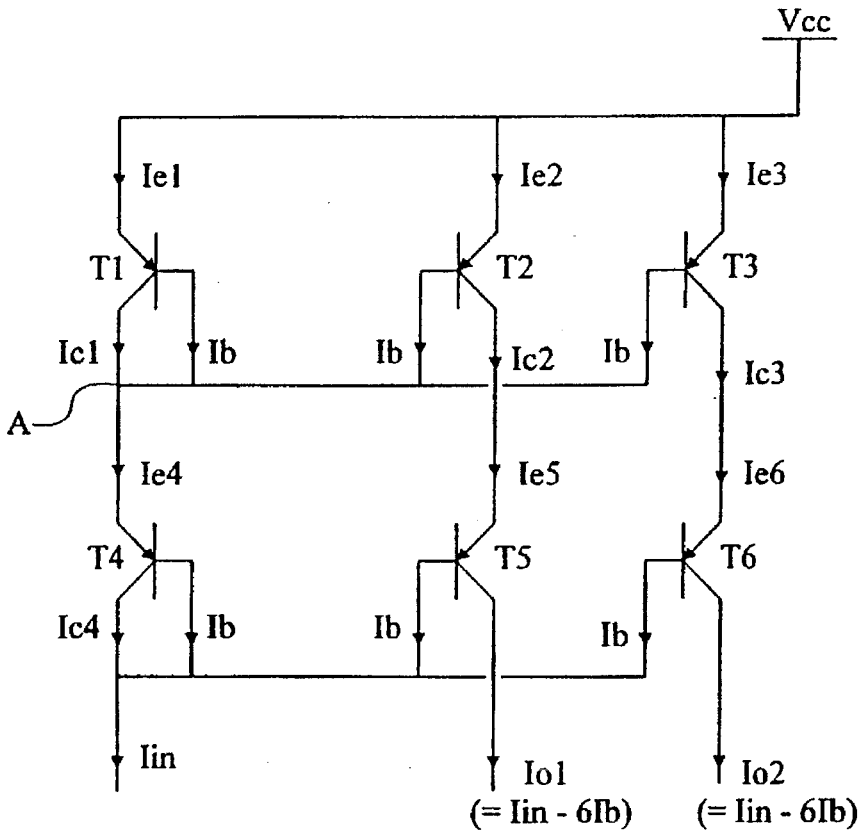
Figure 3:
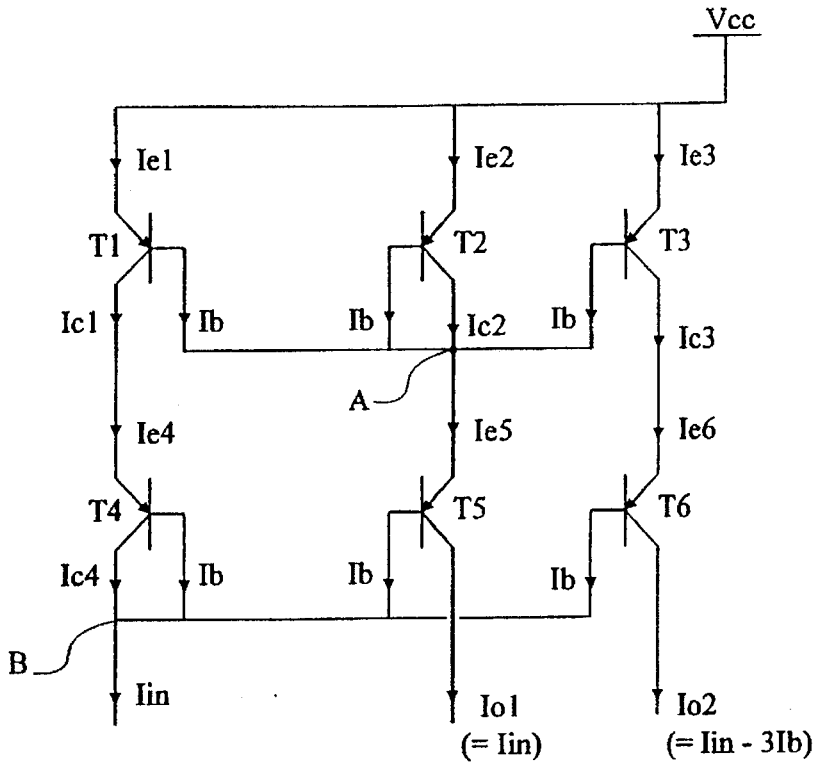
Figure 4:
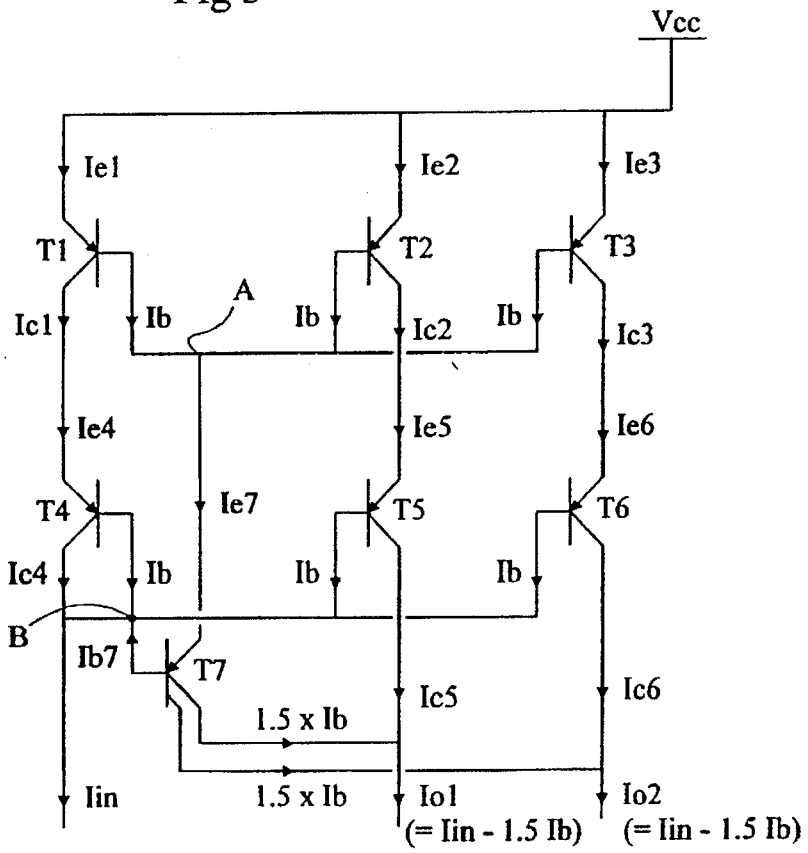
Figure 5:
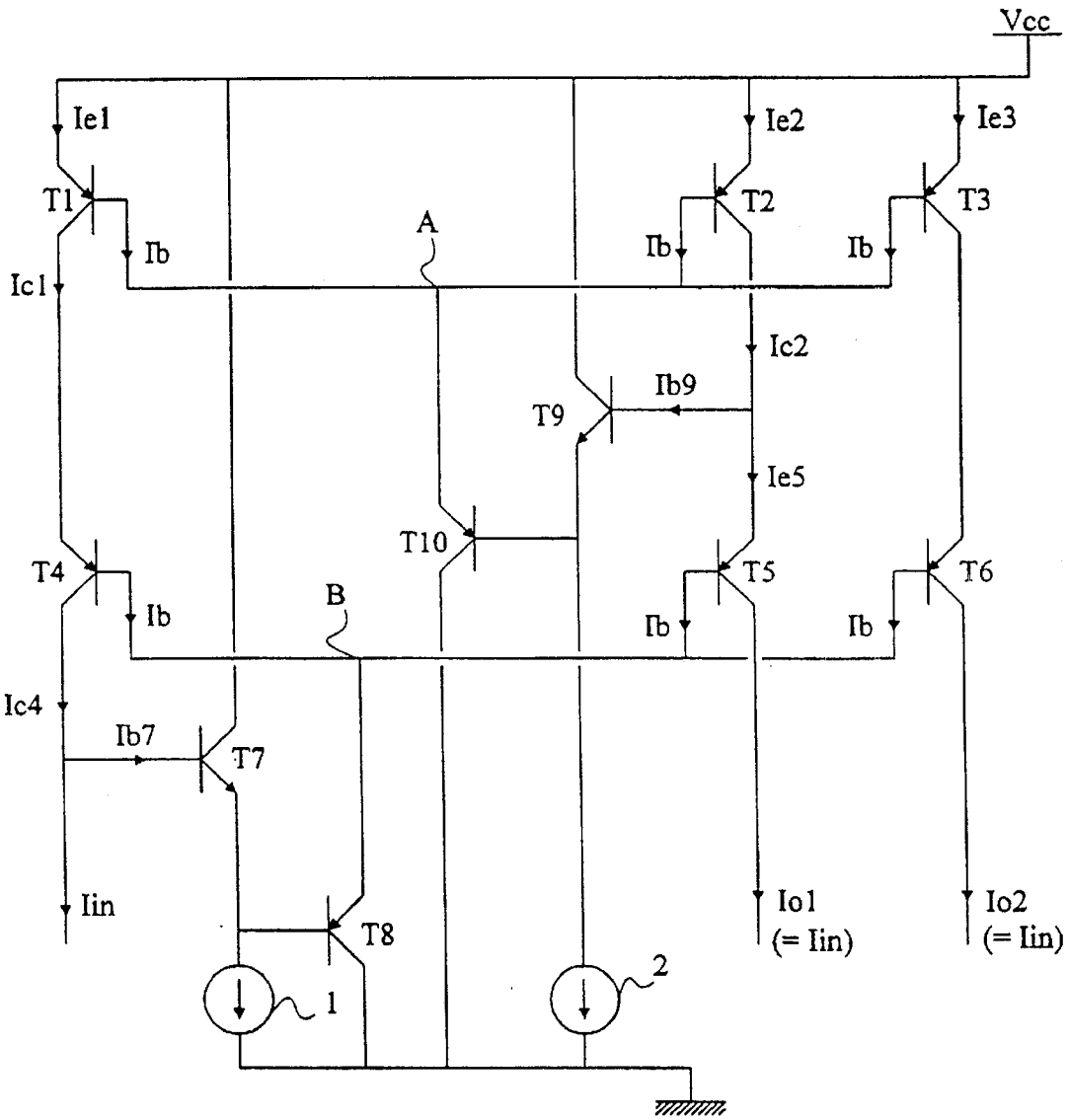

FIG. 7 is a table illustrating some basic features of the current mirrors disclosed above. This table indicates the mirror ratio (Io1/Iin and Io2/Iin) for each output, the matching ratio (Io2/Io1), the presence or the absence of a high output impedance. It also indicates the number of transistors used, the variation of the mirror ratio with the number of outputs, and the variations of the mirror ratio for various input currents. This latter feature has been indicated only for the circuits of FIG. 5 and FIG. 6.

As it will be noted from the table, the invention optimizes all the features of a current mirror with a reduced number of transistors.

By reproducing the value of the base currents of the mirror transistors on the collectors of the associated cascode transistors, the compensation of the base currents at the mirror outputs is improved.

The reproductiveness of the selected features of two mirrors made on different chips is improved. Indeed, the values of the base currents that are compensated on the cascode transistors effectively originate from the mirror transistor bases. This was not obtained, for example for a circuit of the type shown on FIG. 5. Accordingly, if the transistor gain varies from one chip to another, the compensation will be made with the value of the base current of each mirror transistor, this value incorporating the transistor gain.

The use of a multi-collector transistor associated with a single current generator improves the reproductiveness of the input current on the various outputs without impairing the mirror ratio.

The number of transistors used is limited.

The architecture of the mirror according to the invention makes it possible to form a multiple output mirror providing different output currents while maintaining all the features of reproductiveness and fiability.

The invention more particularly relates to an integrated current mirror applied to a charge pump circuit or to a current controlled oscillator circuit. In such a circuit, the electrical features of the current mirror are critical.

Figure 8:
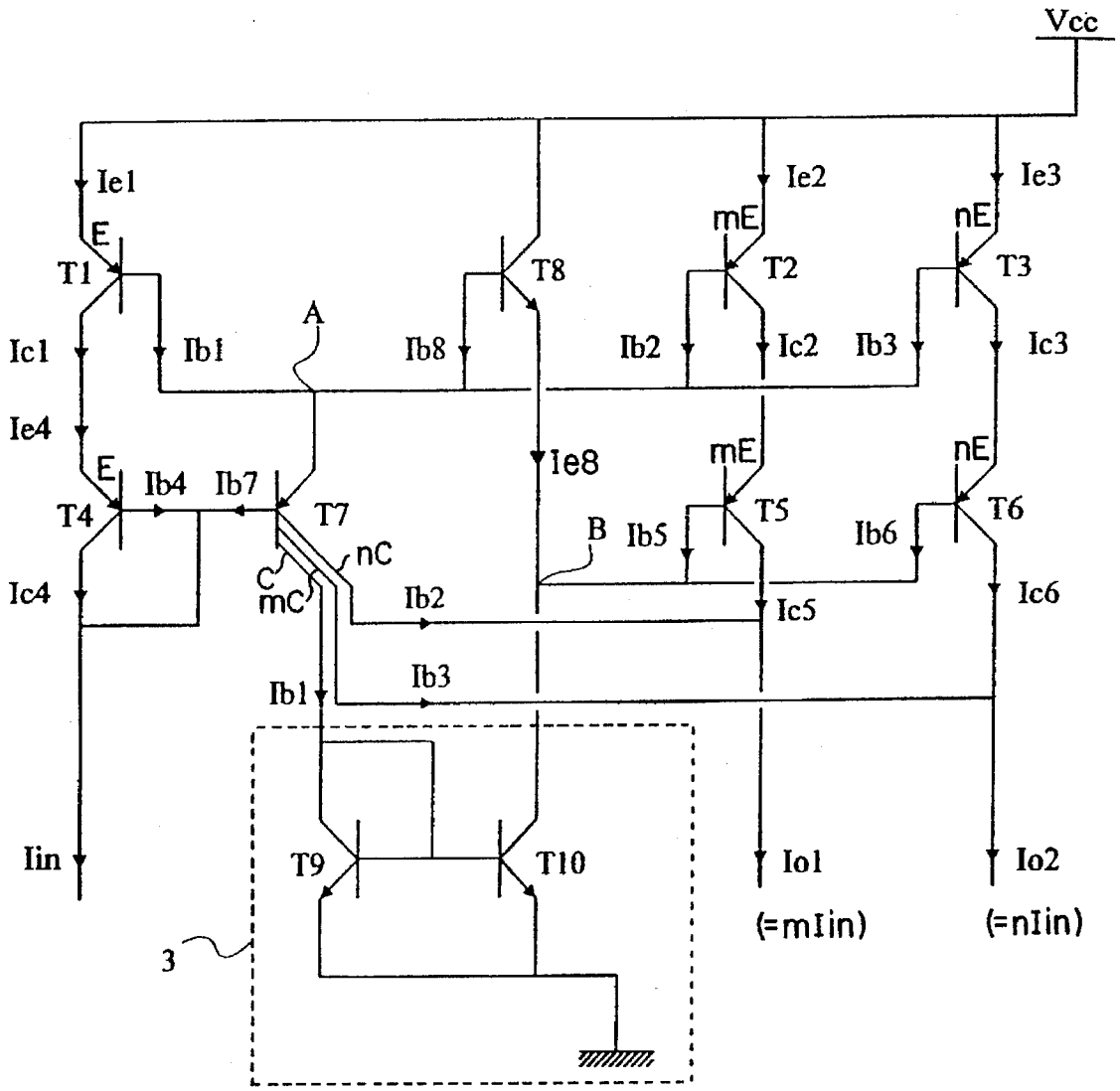
FIG. 8 shows a second embodiment of a multiple output current mirror circuit.

The invention makes it also possible to make a current mirror with outputs having different values, by using an arrangement similar to the one of FIG. 8. Only the emitter and collector surface areas of some transistors are changed.

Such a variant of the invention will be disclosed hereunder in connection with FIG. 8. The multi-collector transistor T7 has collectors having different surface areas shown in FIG. 8 as C, mC and nC; that determine the ratios of the base current that have to be added to the collector current Ic5 or Ic6. These ratios correspond to the ratios existing between the emitter surface areas of transistors T1, T2, T3 and T4, T5, T6 labeled in FIG. 8 as E, mE, and nE. In this example, it is assumed that transistors T1 and T4 have a unit emitter surface area. Transistors T2 and T5 have an emitter surface area having a ratio m with respect to the emitter surface areas of transistors T1 and T4. Transistors T3 and T6 have an emitter surface area presenting a ratio n with respect to transistors T1 and T4. Assuming that the base currents Ib1, Ib4 have the value Ib, the base currents Ib2, Ib5 will have the value mIb and the base currents Ib3, Ib6 will have the value nIb. Transistor T7 has a first collector surface area equal to 1, a second collector surface area m and a third collector surface area n.

Accordingly, for a given input current Iin, the collector currant Ic4 of transistor T4 is equal to Iin−Ib. The emitter current Ie4=Iin and the emitter current Ie1=Iin+Ib. Ie2=m (Iin+Ib) and Ie3=n(Iin+Ib). Ic2 and Ic3 are respectively equal to mIin and nIin. Similarly, Ic5=m (Iin−Ib) and Ic6=n(Iin−Ib). The ratio between the surface areas of the collectors of transistor T7 is chosen for corresponding to the ratio of the emitter surface areas of the mirror transistors T1, T2 and T3. So, transistor T7 provides on its collectors respective currents Ib, mIb, nIb. Therefore, Io1=mIin and Io2=nIin.

As before, the current generator 3 absorbs, through the collector of transistor T10, a current higher than the sum of the base currents Ib5 and Ib6. That is, the current gain of the current generator 3 should be higher than m+n. This gain is determined by the ratio between the emitter surfaces of transistors T9 and T10.

The mirror ratio obtained in this case is m for the first output and n for the second output and the matching ratio between the outputs Io2 and Io1 is n/m.

It will be apparent to those skilled in the art that the invention can be implemented in various manners. In particular, each of the disclosed components can be substituted by one or a plurality of elements having the same function. For example, the current generator 3 disclosed as comprising two NPN transistors could be made by other means, for example the association of resistors and transistors.

Having thus described at least one illustrative embodiment of the invention, various alterations, modifications, and improvements will readily occur to those skilled in the art. Such alterations, modifications, and improvements are intended to be within the spirit and scope of the invention. Accordingly, the foregoing description is by way of example only and is not intended as limiting. The invention is limited only as defined in the following claims and the equivalents thereto.

What is claimed is:

1. A multiple output current mirror comprising:

at least three mirror connected PNP transistors, including a first mirror transistor and at least two additional mirror transistors, each mirror transistor having a base, an emitter and a collector, said base of each mirror transistor being connected to a first node;

at least three cascade connected transistors including a first cascade transistor and at least two additional cascade transistors, each one of the cascade transistors having a base and a collector, each one of the cascade transistors being coupled to a corresponding one of the mirror transistors;

a current input terminal coupled to the collector of the first cascade transistor;

at least two mirror output terminals respectively coupled to the collectors of the at least two additional cascade transistors; and means for detecting a base current of each one of the mirror connected PNP transistors, and for each one of the mirror connected PNP transistors, reproducing its base current on the collector of its corresponding cascade transistor.

2. The multiple output current mirror according to claim 1, wherein the emitter of each of the at least three mirror connected PNP transistors has a surface area, and wherein the means for detecting includes a multi-collector transistor having an emitter coupled to the first node, a base coupled to the base and collector of the first cascade transistor, and a plurality of collectors each having a surface area, a ratio between the surface areas of the plurality of collectors of the multi-collector transistor corresponding to a ratio between the surface areas of the emitters of the at least three mirror connected transistors.

3. The multiple output current mirror according to claim 1, wherein the emitter of each of the at least three mirror connected PNP transistors has a surface area, wherein each of the at least three cascade connected transistors has an emitter having a surface area, and wherein ratios between the surface areas of the emitters of the at least three mirror connected transistors are identical to ratios between the surface areas of the emitters of the corresponding cascade transistors.

4. The multiple output current mirror according to claim 1, wherein the emitter of each of the at least three mirror connected PNP transistors has a surface area, and wherein the means for reproducing includes a current generator having an input that receives a current equivalent to the base current of the first mirror transistor, and an output that draws a current from a second node corresponding to an interconnection of the bases of the at least two additional cascade transistors, the current generator having a current gain that is larger than a ratio between a sum of the surface areas of the emitters of the at least two additional mirror transistors and the surface area of the emitter of the first mirror transistor.

5. The multiple output current mirror according to claim 4, wherein the current generator includes a first NPN transistor and a second NPN transistor, each having a base, an emitter and a collector, the bases of the first and second NPN transistors being coupled to the collector of the first NPN transistor, the emitters of the first and second NPN transistors being grounded, the collector of the first NPN transistor being coupled to a first collector of the multi-collector transistor to receive a current substantially equal to the base current of the first mirror transistor, and the collector of the second NPN transistor being coupled to the second node.

6. The multiple output current mirror according to claim 4, further comprising means for setting collector-emitter voltages of the at least three mirror connected transistors to a same value.

7. The multiple output current mirror according to claim 6, wherein said means for setting includes an NPN transistor having a collector coupled to a voltage supply, a base coupled to the first node, and an emitter coupled to the second node.

8. A multiple output current mirror according to claim 2, wherein each of the at least three cascade connected transistors has an emitter having a surface area, and wherein ratios between the surface areas of the emitters of the at least three mirror connected transistors are identical to ratios between the surface areas of the emitters of the corresponding cascade transistors.

9. The multiple output current mirror according to claim 8, wherein the means for reproducing includes a current generator having an input that receives a current equivalent to the base current of the first mirror transistor, and an output that draws a current from a second node corresponding to an interconnection of the bases of the at least two additional cascade transistors, the current generator having a current gain that is larger than a ratio between a sum of the surface areas of the emitters of the at least two additional mirror transistors and the surface area of the emitter of the first mirror transistor.

10. The multiple output current mirror according to claim 9, wherein the current generator includes a first NPN transistor and a second NPN transistor each having a base, an emitter and a collector, the bases of the first and second NPN transistors being coupled to the collector of the first NPN transistor, the emitters of the first and second NPN transistors being grounded, the collector of the first NPN transistor being coupled to a first collector of the multi-collector transistor to receive a current substantially equal to the base current of the first mirror transistor, and the collector of the second NPN transistor being coupled to the second node.

11. The multiple output current mirror according to claim 10, further comprising means for setting collector-emitter voltages of the at least three mirror connected transistors to a same value.

12. The multiple output current mirror according to claim 11, wherein said means for setting includes an NPN transistor having a collector coupled to a voltage supply, a base coupled to the first node, and an emitter coupled to the second node.

13. A multiple output current mirror circuit comprising:

M mirror transistors, including a first mirror transistor and M-1 additional mirror transistors, each of the M mirror transistors having a base, an emitter and a collector, said base being coupled to a first node, said emitter being coupled to a reference voltage;

M cascade transistors, including a first cascade transistor and M-1 additional cascade transistors, each one of the M cascade transistors corresponding to a respective one of the M mirror transistors, each of the M cascade transistors having a base, an emitter coupled to the collector of its respective mirror transistor, and a collector, the collector of the first cascade transistor being a current input terminal that receives an input current, the collector of each of the additional cascade transistors being coupled to a mirror output terminal; and a control circuit, coupled to the bases of the M cascade transistors, that ensures that, independent of a value of the input current, an output current at each one of the mirror output terminals is substantially equal to the input current multiplied by a mirror ratio of the one of the mirror output terminals, the control circuit including means for setting an emitter current of each one of the additional cascade transistors and the output current of the mirror output terminal to which the one of the additional cascade transistors is coupled to be substantially equal.

14. The multiple output terminal of claim 13, wherein the control circuit includes means for reproducing a base current of each one of the additional mirror transistors at the mirror output terminal of its corresponding additional cascade transistor.

15. The multiple output terminal of claim 14, wherein the control circuit includes means for setting collector currents of the M cascade transistors to be equal.

16. The multiple output current mirror of claim 15, further comprising means for setting collector-emitter voltages of the mirror transistors to be equal.

17. The multiple output current mirror of claim 13, further comprising means for setting collector-emitter voltages of the mirror transistors to be equal.

18. The multiple output current mirror circuit of claim 13, wherein each of the emitters of the M cascade transistors has a surface area, and wherein the mirror ratio of each one of the mirror output terminals equals a ratio of the surface area of the emitter of the additional cascade transistor whose collector forms the one of the mirror output terminals to the surface area of the emitter of the first cascade transistor.

19. A method of providing output currents that mirror an input current from a mirror circuit, the mirror circuit having a plurality of mirror transistors, including a first mirror transistor coupled to a current input terminal to receive the input current and a plurality of additional mirror transistors each respectively coupled to a mirror output terminal having a mirror ratio, the method including steps of:

A. receiving the input current at the current input terminal;

B. providing, for any value of the input current, an output current at each output terminal that is equal to the input current multiplied by the mirror ratio for the output terminal;

C. detecting a base current of each of the plurality of additional mirror transistors; and D. reproducing the base current of each of the additional mirror transistors in its respective mirror output terminal.

20. The method of claim 19, wherein step B further includes a step of setting collector currents of the plurality of mirror transistors to be equal.

21. The method of claim 19, wherein each of the mirror transistors has a collector and an emitter, and wherein step B includes setting collector-emitter voltages of the mirror transistors to be equal.

22. A multiple output current mirror circuit comprising:

M mirror transistors, including a first mirror transistor and M-1 additional mirror transistors, each of the M mirror transistors having a base, an emitter, and a collector, each of the M-1 additional mirror transistors having a base current, the emitter of each of the M mirror transistors being coupled to a reference voltage, the base of each of the M mirror transistors being coupled to a first node;

M cascade transistors, including a first cascade transistor and M-1 additional cascade transistors, each one of the M cascade transistors corresponding to a respective one of the M mirror transistors, each of the M cascade transistors having a base, an emitter coupled to the collector of its respective one of the M mirror transistors, and a collector, the collector of the first cascade transistor being a current input terminal that receives an input current, the collector of each of the additional cascade transistors being coupled to a corresponding mirror output terminal that provides output current; and a reproducing circuit that reproduces the base current of each of the additional mirror transistors in the mirror output terminal of the corresponding additional cascade transistor.

23. The multiple output current mirror circuit according to claim 22, wherein the emitter of each of the M mirror transistors has a surface area, and wherein the current reproducing circuit includes a current generator and a multi-collector transistor, the multi-collector transistor having an emitter coupled to the first node, a base coupled to the base and collector of the first cascade transistor, and M collectors including a first collector coupled to the current generator and M-1 additional collectors each coupled to a collector of one of the M-1 additional cascade transistors, each of the M collectors having a surface area, ratios between the surface areas of the M collectors of the multi-collector transistor corresponding to ratios between the surface areas of the emitters of the M mirror transistors.

24. The multiple output current mirror circuit according to claim 23, wherein the emitter of each of the M cascade transistors has a surface area, and wherein ratios between the surface areas of the emitters of the M mirror transistors are identical to ratios between surface areas of the emitters of the corresponding M cascade transistors.

25. The multiple output current mirror circuit according to claim 23, wherein:

each of the emitters of the M cascade transistors has a surface area;

each of the additional cascade transistors has a base connected at a second node; and the current generator has an input that receives a current equal to a base current of the first mirror transistor and an output that draws a current from the second node, the current generator having a current gain greater than a ratio between a sum of the surface areas of the emitters of the additional mirror transistors and the surface area of the emitter of the first mirror transistor.

26. The multiple output current mirror circuit according to claim 25, wherein the current generator includes a first NPN transistor and a second NPN transistor each having a base, an emitter, and a collector, the bases of the first and second NPN transistors being coupled to the collector of the first NPN transistor and the emitters of the first and second NPN transistors being coupled to a ground, the collector of the first NPN transistor being coupled to a first collector of the multi-collector transistor to receive a current equal to the base current of the first mirror transistor, the collector of the second NPN transistor being coupled to the second node.

27. The multiple output current mirror circuit according to claim 24, wherein the current reproducing circuit further includes a transistor having a collector coupled to a voltage supply, a base coupled to the first node, and an emitter coupled to the second node.

28. The multiple output current mirror circuit of claim 22, wherein each emitter of the M cascade transistors has a surface area, and wherein each one of the mirror output terminals has a corresponding mirror ratio equaling a ratio of the surface area of the emitter of the additional cascade transistor whose collector forms the mirror output terminal to the surface area of the emitter of the first cascade transistor.

29. The multiple output current mirror circuit according to claim 26, wherein the current reproducing circuit further includes a transistor having a collector coupled to a voltage supply, a base coupled to the first node, and an emitter coupled to the second node.

30. The multiple output current mirror circuit according to claim 24, wherein the current generator includes a first NPN transistor and a second NPN transistor each having a base, an emitter, and a collector, the bases of the first and second NPN transistors being coupled to the collector of the first NPN transistor and the emitters of the first and second NPN transistors being coupled to a ground, the collector of the first NPN transistor being coupled to a first collector of the multi-collector transistor to receive a current equal to the base current of the first mirror transistor, the collector of the second NPN transistor being coupled to a second node.

31. The multiple output current mirror circuit of claim 29, wherein each emitter of the M cascade transistors has a surface area, and wherein each one of the mirror output terminals has a corresponding mirror ratio equaling a ratio of the surface area of the emitter of the additional cascade transistor whose collector forms the mirror output terminal to the surface area of the emitter of the first cascade transistor.

32. The multiple output current mirror circuit according to claim 31, in combination with a charge pump circuit.

33. The multiple output current mirror circuit according to claim 31, in combination with a current controlled oscillator circuit.

34. The multiple output current mirror circuit according to claim 22, in combination with a charge pump circuit.

35. The multiple output current mirror circuit according to claim 22, in combination with a current controlled oscillator circuit.

36. The method of claim 19, further comprising a step of setting an emitter current of each one of the additional mirror transistors and the output current of the mirror output terminal coupled to the one of the additional mirror transistors to be substantially equal.

37. The multiple output current mirror circuit of claim 24 wherein the reproducing circuit is adapted to set an emitter current of each one of the additional cascade transistors and the output current of the mirror output terminal coupled to the one of the additional mirror transistors to be substantially equal.

38. In a mirror circuit having a current input terminal to receive an input current, a plurality of mirror output terminals each having a mirror ratio, a plurality of mirror transistors including a first mirror transistor coupled to the current input terminal, and additional mirror transistors coupled to a respective one of the plurality of mirror output terminals, a method of providing output currents at the mirror output terminals that mirror the input current, the method including steps of:

A. receiving the input current at the current input terminal;

B. providing for any value of the input current, an output current at each one of the plurality of mirror output terminals that is substantially equal to the input current multiplied by the mirror ratio of the one of the plurality or mirror output terminals; and C. setting an emitter current of each one or the additional mirror transistors and the output current of the mirror output terminal coupled to the one of the additional mirror transistors to be substantially equal.

* * * * *

UNITED STATES PATENT AND TRADEMARK OFFICE

CERTIFICATE OF CORRECTION

PATENT NO. : 5,627,732

DATED : May 6, 1997

INVENTOR(S) : Gee H. LOH and Mario SANTI

It is certified that error appears in the above-identified patent and that said Letters Patent is hereby corrected as shown below:

On the title page: Item [73] Assignee: should read

SGS-Thomson Microelectronics Pte Ltd, Singapore and Seoul, South Korea

Signed and Sealed this

Sixth Day of January, 1998

*Attest:*

*Attesting Officer*

BRUCE LEHMAN

*Commissioner of Patents and Trademarks*